US005176558A

United States Patent [19]

Newell

[11] Patent Number: 5,176,558

[45] Date of Patent: Jan. 5, 1993

[54] METHODS FOR REMOVING CONTAMINANTS FROM ARC DISCHARGE LAMPS

[75] Inventor: Philip B. Newell, Carlisle, Mass.

[73] Assignee: GTE Products Corporation, Danvers, Mass.

[21] Appl. No.: 693,899

[22] Filed: May 1, 1991

[51] Int. Cl.[5] ..... H01J 9/32; H01J 9/38

[52] U.S. Cl. ..... 445/26; 445/6; 445/40; 445/43

[58] Field of Search ..... 445/16, 17, 18, 26, 445/22, 40, 43, 57, 6

[56] References Cited

U.S. PATENT DOCUMENTS

| | | | |
|---|---|---|---|
| 2,391,573 | 12/1945 | Herzog | 445/22 |
| 2,454,745 | 11/1948 | Quinn | 445/22 |
| 3,208,812 | 9/1965 | Brundidge | 445/16 |
| 3,492,598 | 1/1970 | MacNair | 445/57 |

FOREIGN PATENT DOCUMENTS

| | | | |
|---|---|---|---|
| 55-39103 | 3/1980 | Japan | 445/43 |
| 111665 | 4/1962 | Pakistan | 445/43 |

OTHER PUBLICATIONS

R. L. Hansler et al., "A New Low Wattage Metal Halide Process", IES Annual Conference, 1985, pp. 109–122.

*Primary Examiner*—Richard K. Seidel
*Assistant Examiner*—Jeffrey T. Knapp
*Attorney, Agent, or Firm*—Robert E. Walter

[57] ABSTRACT

A method for removing contaminants from an arc tube includes introducing an inert gas into the arc tube through a conduit extending through the lamp tubulation and exhausting the gas through the space between the conduit and the wall of the lamp tubulation. Contaminated gas thereby always flows away from the arc tube. The arc tube can be heated during the gas flushing process to release adsorbed water and vaporize volatile oxides. Gas is preferably flushed through the lamps tubulation during and after press sealing of electrodes into the arc tube to remove contaminants introduced during press sealing.

1 Claim, 4 Drawing Sheets

METHODS FOR REMOVING CONTAMINANTS FROM ARC DISCHARGE LAMPS

FIELD OF THE INVENTION

This invention relates to methods for manufacture of arc discharge lamps and, more particularly, to methods for removing contaminants from arc tubes using a technique in which gas is flushed through a lamp.

BACKGROUND OF THE INVENTION

Some arc discharge lamps, such as metal halide lamps, contain fill materials generally including mercury, an inert gas and one or more metal halides which produce vapors that support a luminous arc discharge during operation. The presence of other materials, even in small quantities, contaminates the arc tube and can cause a reduction in light output, a change in color temperature or operating voltage and/or premature lamp failure. Contaminants can be introduced into the arc tube at various times during the manufacturing process. In particular, contaminants introduced during the electrode sealing process or remaining after electrodes are sealed into the lamp are difficult to remove. In the case of metal halide lamps, such contaminants include silica smoke (silica which has vaporized and then recondensed), tungsten oxides originating from the electrodes and water which adsorbed on surfaces inside the arc tube.

Various techniques are known for removing contaminants from arc tubes. Typically, a series of steps are used to remove contaminants, including washing the arc tube with hydrofluoric acid to remove silica smoke, baking the arc tube for 6–24 hours to volatilize and drive off tungsten oxides and water, repeated filling and exhausting with a gas, and striking an arc to clean the electrodes. These steps are relatively expensive and time-consuming and can potentially introduce additional contaminants if they are not carefully controlled.

In the fill and exhaust method of flushing an arc tube, a gas is introduced into the arc tube through the lamp tubulation and then is removed by a vacuum pumping through the tubulation. This procedure is repeated to reduce the contaminant level gradually. However, this technique is not particularly effective. Since the same tubulation is used for both fill and exhaust, contaminants are deposited on the tubulation wall during exhaust and are reintroduced into the arc tube during succeeding fill cycles.

A method for manufacturing metal halide lamps which utilizes an arc tube without a tubulation is disclosed by R. L. Hansler et al in "A New Low Wattage Metal Halide Process", IES Annual Conference, 1985, pages 109–122. In the Hansler et al process, argon is flushed through the arc tube from end to end during the process until the electrodes are sealed in the ends of the tube. During this flush, contaminants driven from the wall, etc., will be carried out. The Hansler et al process overcomes the problem of recontamination that arises from flush pumping, but does not remove contaminants which remain after the electrodes are sealed into the arc tube.

It is a general object of the present invention to provide improved methods for manufacturing arc tubes.

It is another object of the present invention to provide improved methods for removing contaminants from arc tubes.

It is a further object of the present invention to provide methods for removing contaminants from arc tubes after electrodes are sealed therein.

It is yet another object of the present invention to provide methods for removing contaminants from arc tubes, wherein contaminants are completely purged from the system and not available for reintroduction into the same lamp or different lamps.

It is a further object of the present invention to provide a method for manufacturing arc tubes in which contaminants may be removed without the utilization of vacuum pumps.

It is still another object of the present invention to provide methods for removing contaminants from arc tubes during and after a press sealing operation.

It is still another object of the present invention to provide methods for removing contaminants from arc tubes at atmospheric pressure or above.

SUMMARY OF THE INVENTION

According to the present invention, these and other objects and advantages are achieved in a method for removing contaminants from an arc tube having a lamp tubulation and having electrodes mounted therein. The method comprises the steps of introducing a gas into the arc tube through a first gas flow passage extending through the lamp tubulation, and exhausting the gas from the arc tube through a second gas flow passage extending through the lamp tubulation, the second gas flow passage being separate from the first gas flow passage, whereby gas flows in a stream through the first gas flow passage into the discharge lamp and then flows from the discharge lamp only through the second gas flow passage.

In a preferred embodiment, the gas is introduced into the arc tube through a conduit extending longitudinally through the lamp tubulation, and the gas is exhausted through a space between the conduit and a wall of the lamp tubulation. The gas is an inert gas such as argon or nitrogen. Thus, in accordance with the invention, there is provided a flushing technique characterized by a continuous flow of gas through the needle into the arc tube and an exhaust flow through the space between the needle and the wall of the tubulation. The gas can be exhausted by vacuum pumping or can be exhausted into atmosphere. Since the contaminated gas from the arc tube does not flow through the needle, contamination of incoming gas is avoided.

The method of the invention can further include the step of heating the arc tube as gas is flushed through the arc tube as described above. The arc tube is preferably heated sufficiently to release water adsorbed on inside surfaces of the arc tube. The arc tube can be heated with a torch or can be heated in an oven.

The method of the invention can further include the step of striking an arc discharge between the electrodes in the arc tube as a gas is flushed through the arc tube as described above. The striking of an arc discharge causes contaminants to be removed from the electrodes and carried out of the arc tube by the gas flow. The steps of heating the arc tube and striking an arc discharge can be performed either simultaneously or sequentially.

According to another aspect of the invention, there is provided a method for sealing an electrode into an arc tube having a lamp tubulation. The method comprises the steps of heating a seal region of the arc tube, positioning an electrode assembly in the seal region, pressing the seal region together to seal the electrode assembly therein, and causing a gas to flow into the arc tube through a first gas flow passage extending through the lamp tubulation and to flow from the arc tube through a second gas flow passage also extending through the lamp tubulation, the second gas flow passage being separate from the first gas flow passage. Preferably, gas is caused to flow through the arc tube during and after the step of pressing the seal region together. Thus, contaminants generated while the arc tube is still hot from the press sealing process are removed.

Preferably, the gas is introduced into the arc tube during press sealing through a conduit such as a stainless steel needle extending longitudinally through the lamp tubulation, and the gas is exhausted from the arc tube through a space between the conduit and a wall of the lamp tubulation. In a preferred embodiment, the needle has a distal end which is positioned in the lamp tubulation a few millimeters from the arc tube, in order to protect it from the extreme heat near the seal area. Arc tubes manufactured in accordance with the methods of the present invention are substantially free of contaminants and exhibit superior operating characteristics.

BRIEF DESCRIPTION OF THE DRAWINGS

For a better understanding of the present invention, together with other and further objects, advantages and capabilities thereof, reference is made to the accompanying drawings which are incorporated herein by reference and in which.

DETAILED DESCRIPTION OF THE INVENTION

Figure 1:
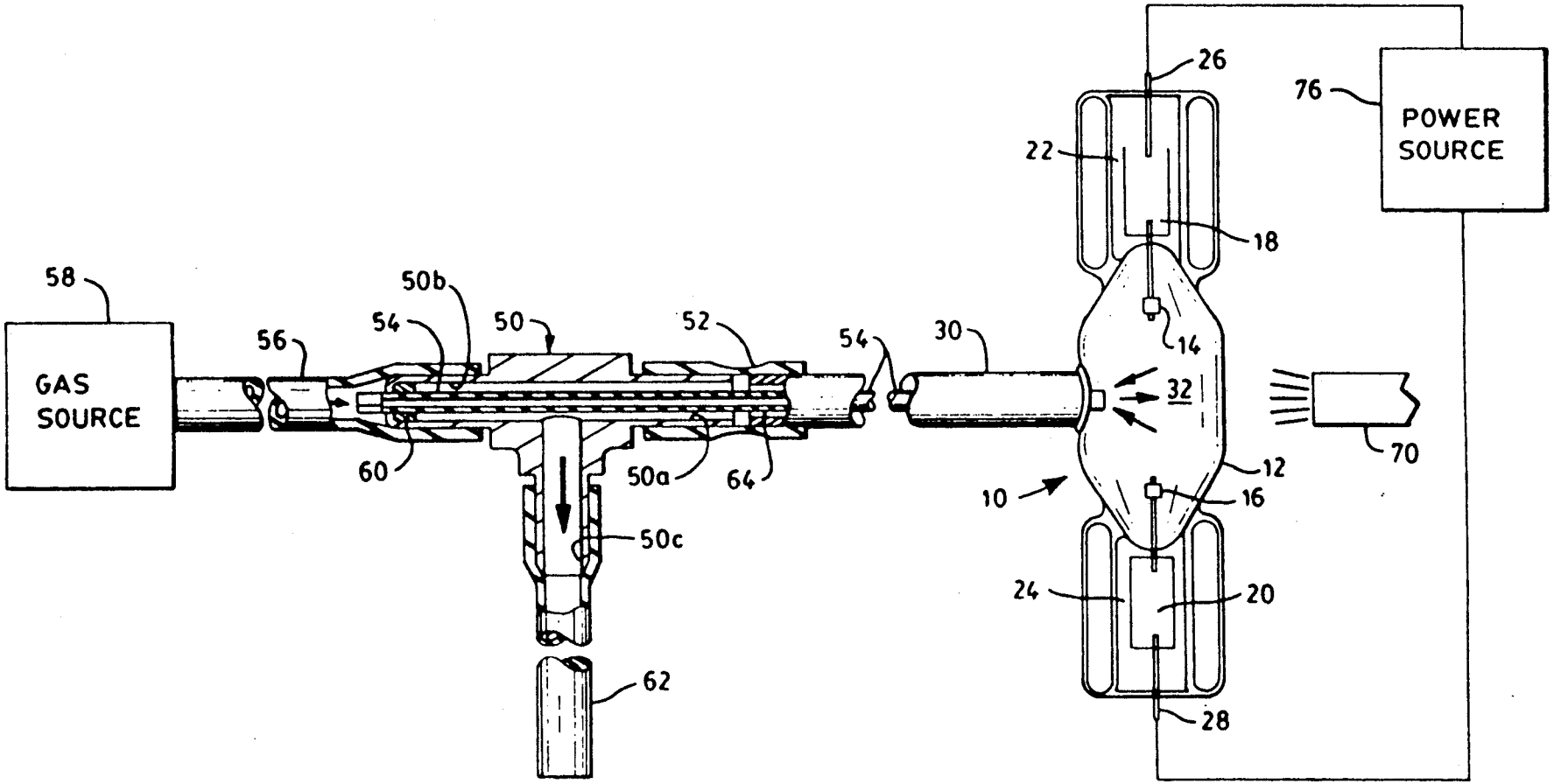
FIG. 1 is a schematic diagram, partially in cross-section, which illustrates a method for removing contaminants in accordance with the present invention.

A system for removing contaminants from an arc tube is shown in FIG. 1. An arc lamp 10 includes an arc tube 12 and electrodes 14 and 16 sealed in opposite ends of the arc tube 12. Molybdenum foils 18 and 20 form electrical feedthroughs in press seal regions 22 and 24, respectively. External leads 26 and 28 are connected to molybdenum foils 18 and 20, respectively. A lamp tubulation 30 extends from a side of the arc tube 12 and provides a passage to an interior discharge region 32 within arc tube 12. During the lamp manufacturing process, the chemicals are introduced, the arc tube 12 is sealed, and the tubulation 30 is removed. The arc tube 12 and tubulation 30 are typically quartz.

As described above, the arc lamp 10, after sealing of electrodes 14 and 16 into the arc tube 12, may contain contaminants which can adversely affect lamp operation. These contaminants typically include silica smoke, tungsten oxides and water. The system shown in FIG. 1 provides a means for effectively removing such contaminants.

A T-fitting 50 has one arm 50*a* connected to lamp tubulation 30 with a flexible tube 52. A conduit such as a small diameter needle 54 extends through T-fitting 50, tube 52 and lamp tubulation 30 and terminates within discharge region 32 or in a portion of lamp tubulation 30 just outside discharge region 32. A second arm 50*b* of T-fitting 50 is connected by a flexible tube 56 to a gas source 58. An O-ring 60 or other suitable seal is positioned within arm 50*b* around needle 54 so that the gas source 58 and needle 54 are isolated from the interior of T-fitting 50. The interior of T-fitting 50 is in gas communication with a space between needle 54 and the wall of lamp tubulation 30 An exhaust tube 62 is connected to arm 50*c* of T-fitting 50. Hose clamps (not shown) can be provided on tubes 56 and 62 to seal the interior of arc tube 12 between processing steps.

In operation, an inert gas is pumped by gas source 58 through tube 56 and needle 54 into the interior discharge region 32 of arc tube 12. A preferred inert gas is pure argon. Another suitable inert gas is nitrogen. The gas circulates through the discharge region 32 and then flows out of the arc tube 12 through a generally annular space 64 between needle 54 and the wall of tubulation 30. The gas carrying contaminants is exhausted through arm 50*c* and tube 62, either to atmosphere or to a vacuum pump (not shown). It can be seen that gas from source 58 flows into arc tube 12 through a first gas flow passage in needle 54 and flows out of arc tube 12 through a second gas flow passage between needle 54 and tubulation 30. This configuration is particularly important in achieving an arc lamp 10 with a very low level of contamination. The disclosed configuration insures that gas flows in only one direction through the system. Gas carrying contaminants from discharge region 32 passes only through the annular space 64 and does not pass through needle 54. Thus, contaminants which may be deposited on the walls of annular space 64 are not later carried into the discharge region 32 by the gas flow. The disclosed unidirectional gas flow insures that clean gas always flows into the arc tube 12 and that contaminated gas always flows away from the arc tube 12.

In an example of the disclosed system for removing contaminants from arc tubes, the metallic conduit 54 comprises No. 304 stainless steel needles of 16–19 gauge were used. The T-fitting 50 was a one-quarter inch barbed brass T commonly used for pneumatic control, and the O-ring 60 was a type 2-002 Viton A O-ring. Gas flow rates in the range 300–2000 cubic centimeters per minute were utilized. While argon is the preferred inert gas, nitrogen is also suitable.

It will be understood that the present invention is not limited to the structure shown in FIG. 1 and described hereinabove. For example, the T-fitting 50 can be replaced with an arrangement wherein the exhaust gas from the arc tube 12 passes into an exhaust manifold in a production machine. Furthermore, any configuration where gas is introduced into the arc tube 12 through a first passage in tubulation 30 and exhausted from arc tube 12 through a second passage in tubulation 30 is suitable. The primary requirement is that the passage for gas inflow be isolated from the passage for gas outflow so that the contaminated gas being exhausted from the arc tube 12 does not contaminate the passage through which gas is introduced into the arc tube 12.

A significant feature of the disclosed system for removing contaminants is that it can operate at atmospheric pressure. Thus, expensive and complex vacuum equipment is not required.

According to another feature of the invention, the arc tube 12 can be heated as gas is flushed through the discharge region 32. The heating causes adsorbed water to be released and volatile contaminants to be vaporized. The contaminants are then carried from the arc tube 12 by the gas flow as described above. In a preferred embodiment, the arc tube 12 is heated with a torch 70 to volatilize water and cause water vapor to become entrained in the gas being flushed through the tube. Alternatively, the arc tube 12 can be heated in an oven. It has been found that adsorbed water and oxygen are removed in a few seconds when the arc tube 12 is torched to incandescence.

According to a further feature of the invention, an arc is initiated between electrodes 14 and 16 during the flushing process as described above. An arc is initiated by connecting a power source 76 to external leads 26 and 28. The power source 76 applies a voltage between electrodes 14 and 16 on the order of 600 volts and thereby initiates an arc discharge. It has been found that after heating as described above, an arc can be initiated in flowing argon at one atmosphere. The arc discharge tends to remove contaminants from electrodes 14 and 16. The arc discharge inherently produces heating of the arc lamp 10.

It will be understood that the heating and arc initiation steps are optional. Furthermore, heating and arc initiation can be performed either simultaneously or sequentially during gas flushing as shown and described hereinabove. When heating is performed during an arc discharge, the entire length of each electrode and coil are heated more uniformly.

Figure 2:
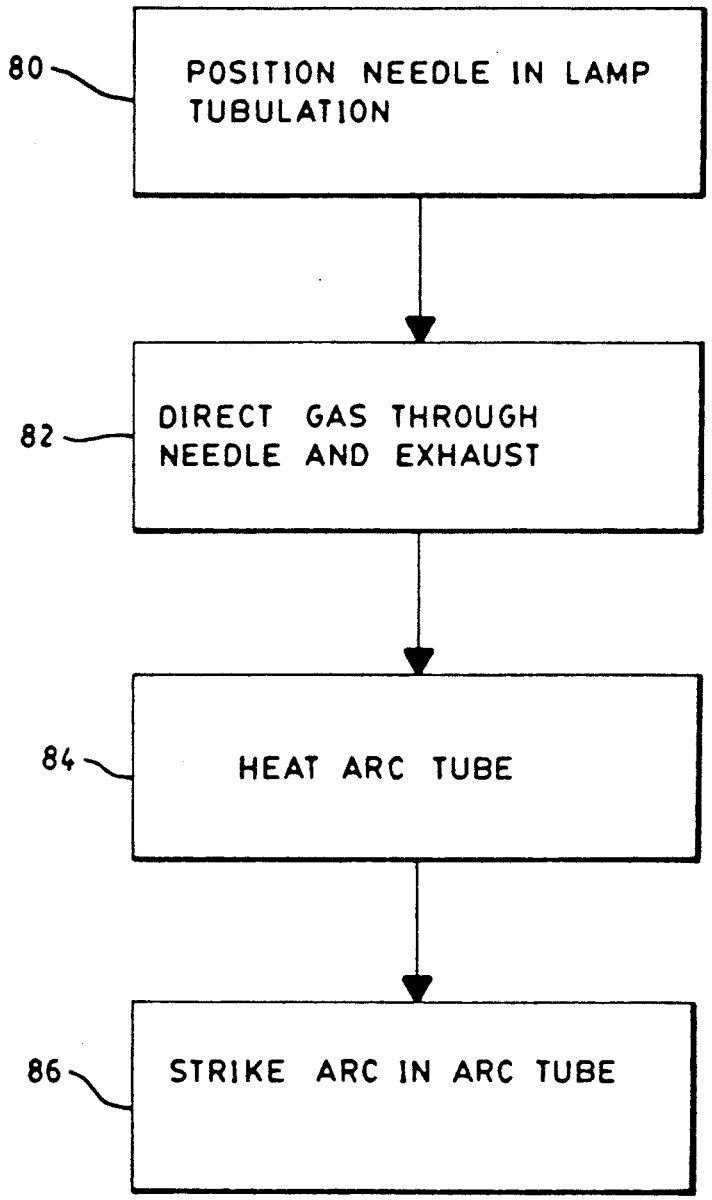
FIG. 2 is a flow diagram which illustrates a method for removing contaminants in accordance with the present invention.

The process of the present invention is summarized in the flow chart of FIG. 2. Initially, a needle 54 connected to a gas source 58 is positioned in lamp tubulation 30 in step 80. Gas is directed from the gas source 58 through needle 54 into the interior discharge region 32 of arc tube 12 in step 82. At the same time, the gas is exhausted from interior discharge region 32 through annular space 64 between needle 54 and tubulation 30 to provide unidirectional gas flow and highly effective flushing of contaminants from discharge region 32. Optionally, the arc tube 12 can be heated by a torch 70 in step 84. Optionally, an arc can be initiated in arc tube 12 in step 86 by application of a suitable voltage from power source 76. Steps 84 and 86 can be performed either simultaneously or sequentially. In either case, steps 84 and 86 are performed simultaneously with step 82 in which gas is flushed through the arc tube 12.

Figure 3:
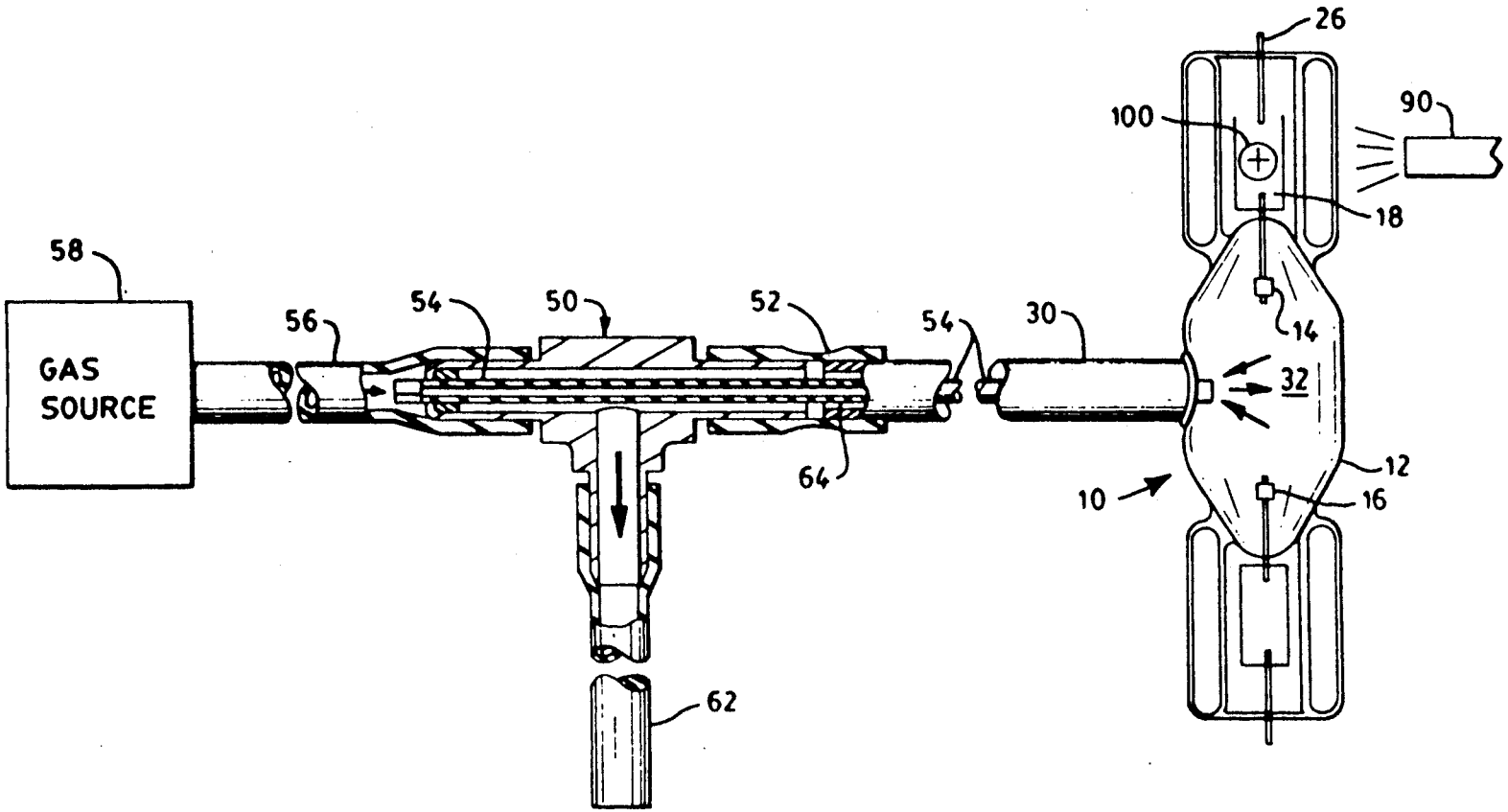
FIG. 3 is a schematic diagram, partially in cross-section, which illustrates a method for removing contaminants during press sealing in accordance with the present invention.
Figure 4:
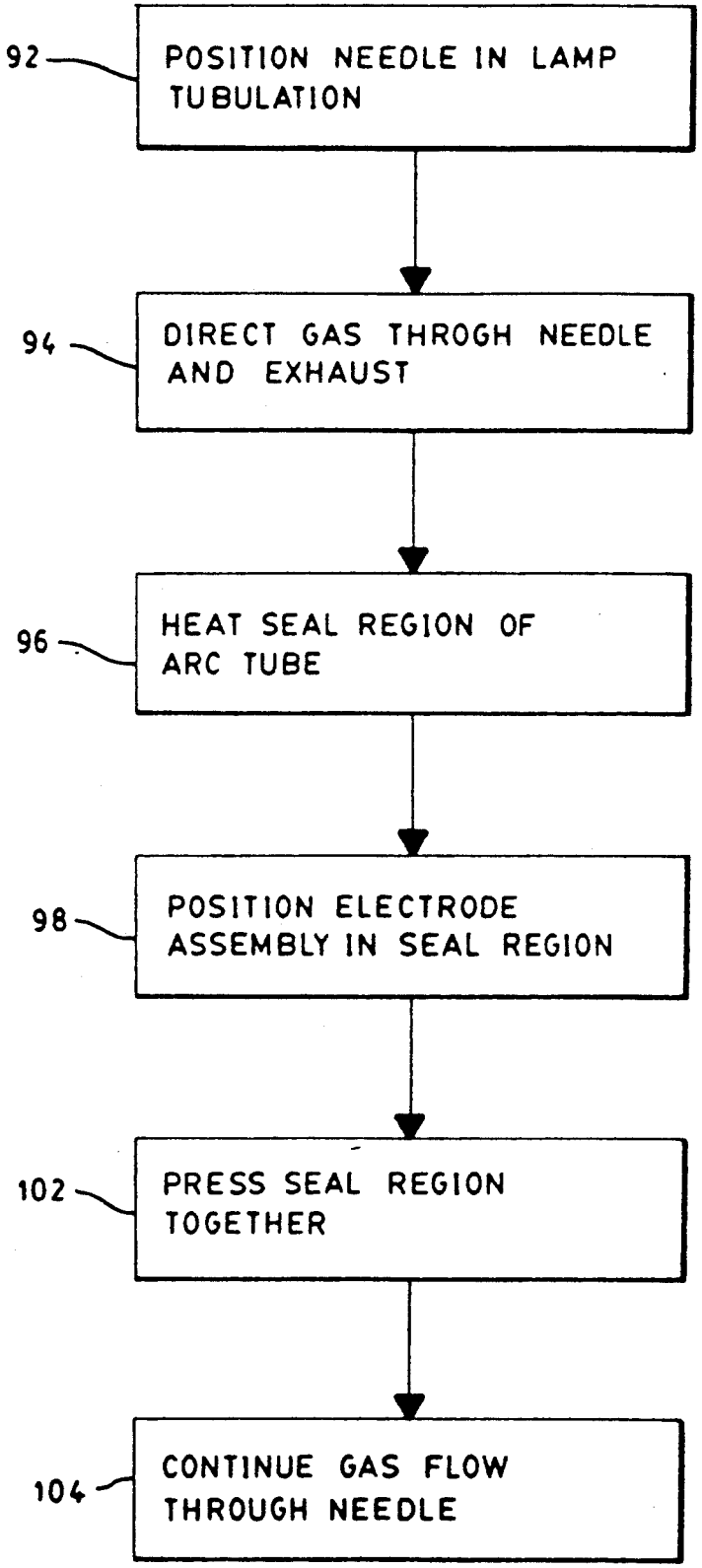
FIG. 4 is a flow diagram which illustrates a method for removing contaminants during press sealing in accordance with the present invention.

Another aspect of the present invention is illustrated in FIGS. 3 and 4. According to this feature of the invention, gas is flushed through the arc tube 12 as shown and described hereinabove during and after a press sealing operation in which electrodes assemblies are sealed into the arc tube 12. The system for flushing gas through arc tube 12 is the same as that shown in FIG. 1 and described hereinabove. Elements in FIG. 3 have the same reference numerals as like elements in FIG. 1. The press sealing operation is shown schematically in FIG. 3. The arc tube 12 prior to press sealing is in the shape of a cylindrical tube having open ends.

The needle 54 is positioned in the tubulation 30 in step 92 (FIG. 4). Gas is directed through needle 54 into arc tube 12 and is exhausted through annular space 64 in step 94 as described in detail hereinabove. One end of the arc tube 12 is heated to the softening point with a torch 90 as indicated in step 96. The torch 90 is directed at the end of arc tube 12 where seal region 22 is to be formed. After sufficient heating, an electrode assembly, including electrode 14, molybdenum ribbon 18 and external lead 26, is inserted through the open end of arc tube 12 as shown in step 98. The gas flushing step 94 continues during and after the press sealing operation. When the press seal region 22 is sufficiently heated and the electrode assembly is properly positioned, press elements (not shown) are brought together against seal region 22 to cause formation of a press seal at molybdenum ribbon 18. The direction of movement of the press elements is perpendicular to the plane of the paper in FIG. 3 as indicated at 100. The formation of the press seal is indicated by step 102. After seal formation, gas flushing through needle 54 is continued in step 104 so that contaminants generated by the high press sealing temperature are removed.

Prior art flushing techniques which relied upon flushing of gas through the ends of arc tube 12 are ineffective in removing contaminants after the electrodes have been sealed in the arc tube. The present invention, by contrast, provides continued flushing of contaminants after formation of press seal 22 and until the entire arc lamp 10 has cooled to a desired temperature.

Prior art press sealed arc tubes which have not been processed in accordance with the present invention almost always have some tungsten oxide and/or silica smoke visible on the electrodes. It is believed that these oxides are a source of oxygen that contributes to tungsten transport from the electrode to the wall, thus causing poor initial lumen output and poor lumen maintenance. Prior art arc tubes pressed at very high quartz temperatures always have electrodes coated with silica smoke. Conversely, prior art arc tubes pressed at colder temperatures exhibit cleaner electrodes but these arc tubes have several other unacceptable faults. It has been shown that there is an optimum set of temperature and other press conditions which will produce an arc tube that is both structurally sound and clean. However, the tolerances of the setup conditions are tight and exceedingly difficult to reproduce and control.

Using stainless steel needles inserted into the tubulation of the arc tube, as shown and described above, through which a flow of nitrogen or other inert gas is injected into the arc tube and exhausted back through the tubulation, sound, clean arc tubes have been produced at very high quartz pressing temperatures. An advantage of using the needle as disclosed is that the flow of gas continues after the press seal is made. The continuing flow of gas both cools the interior of the arc tube and the electrode and carries away any volatile oxides such as tungsten oxide and silicon dioxide that are produced after the press seal is made. It can be demonstrated that the continuing flow is desirable and necessary by blocking the exhaust flow back through the tubulation. In this case, the gas flow stops when the press seal is made, and the silica smoke immediately reappears, particularly when the press seal is made at high temperatures.

The needle 54 is not required to be inserted into the arc tube 12. It is sufficient to bring the tip of the needle 54 in the proximity of the arc tube wall. The jet of gas flowing through the needle is sufficiently collimated to carry into and across the arc tube where it spoils turbulently against the far wall and circulates throughout the arc tube volume. This can be seen by striking an arc in a pressed arc tube while gas is flowing. The stream lines of the flow are easily seen in the plasma. When the needle is inserted too far, it may be damaged by the heat of the press sealing operation.

Stainless steel needles of 16–19 gauge were inserted through a T-fitting equipped with rubber tubing fitted over each arm as shown in FIG. 3 and described above. The needle is sealed in the T by a 2-002 Viton A O-ring so that incoming gas is forced through needle 54 and exhaust gas passes through the arm 50*c* of the T-fitting. After pressing sealing, tubes 56 and 62 are clamped off with the arc tube 12 still attached. The arc tube can be stored in this fashion and transported without becoming contaminated. It was found necessary to preprocess the needle, T-fitting and associated tubing in vacuum and store them in dry nitrogen to assure that moisture from the atmosphere did not adsorb on their surfaces. Nitrogen flow rates of 300–2000 cubic centimeters per minute were used during press sealing.

Arc tubes made as described above have electrodes that appear particularly clean. When the arc tube wall is heated, there are no regions of high emissivity, thus indicating the absence of tungsten or tungsten oxide. These arc tube were transferred directly from the press seal to a dry box where they were dosed with chemicals and subsequently backfilled on a standard fill station. A group of 10 75-watt lamps processed in this manner exhibits an average luminosity exceeding 6000 lumens at 100 hours.

The present invention provides a process in which contaminants adherent to the walls and electrodes of an arc tube are removed from the tube, rather than being redeposited from one surface to another. The oxides that are removed are not on the arc tube walls where they can later cause lumen degradation. In addition, the incoming clean gas is never contaminated by the exhaust gas. By providing clean electrodes, starting of the lamp is improved. It has been demonstrated that lamps processed in accordance with the invention provide superior operation in terms of initial lumen output, lumen output over life, color temperature, color rendition, operating voltage, lifetime and early mortality.

While there have been shown and described what are at present considered the preferred embodiments of the present invention, it will be obvious to those skilled in the art that various changes and modifications may be made therein without departing from the scope of the invention as defined by the appended claims.

What is claimed is:

1. A method for sealing an electrode into an arc tube and removing contaminants from an arc tube having a lamp tubulation and having electrodes mounted therein, said method comprising the steps of:

introducing a gas into said arc tube through a first gas flow passage extending through said lamp tubulation, said gas flow passage comprising a metallic conduit in the form of a needle extending longitudinally through said lamp tubulation;

simultaneously with introducing said gas, positioning an electrode assembly in the seal region and pressing the seal region together to seal said electrode assembly therein simultaneously with introducing said gas, exhausting the gas from said arc tube through a second gas flow passage extending through said lamp tubulation, said second gas flow passage being separated form said first gas flow passage and comprising an annular space between said conduit and a wall of said lamp tubulation, whereby gas flows in a stream through said first gas flow passage into said arc tube and then flows from said arc tube only through said second gas flow passage wherein said steps of introducing the gas and exhausting the gas are performed at about atmospheric pressure;

and simultaneously with introducing said gas, heating said arc tube and initiating an arc discharge between said electrodes in said arc tube.

* * * * *